US008202175B2

(12) United States Patent
Ban

(10) Patent No.: US 8,202,175 B2
(45) Date of Patent: Jun. 19, 2012

(54) GOLF CLUB HEAD

(75) Inventor: Wataru Ban, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 150 days.

(21) Appl. No.: 12/496,162

(22) Filed: Jul. 1, 2009

(65) Prior Publication Data

US 2010/0167837 A1 Jul. 1, 2010

(30) Foreign Application Priority Data

Dec. 25, 2008 (JP) ..... 2008-330932

(51) Int. Cl.
*A63B 53/00* (2006.01)

(52) U.S. Cl. ..... 473/338; 473/345; 473/349; 473/334

(58) Field of Classification Search ..... 473/334–339, 473/349; D21/734, 752
See application file for complete search history.

(56) References Cited

U.S. PATENT DOCUMENTS

| | | | | |
|---|---|---|---|---|
| 1,306,029 | A * | 6/1919 | Robertson | 473/338 |
| 2,067,556 | A * | 1/1937 | Wettlaufer | 473/308 |
| 2,517,245 | A * | 8/1950 | Scott | 473/339 |
| 4,043,563 | A * | 8/1977 | Churchward | 473/338 |
| 4,085,934 | A * | 4/1978 | Churchward | 473/338 |
| 4,206,924 | A * | 6/1980 | Koralik | 473/349 |
| 4,423,874 | A * | 1/1984 | Stuff, Jr. | 473/338 |
| 4,754,977 | A * | 7/1988 | Sahm | 473/337 |
| 4,867,458 | A * | 9/1989 | Sumikawa et al. | 473/336 |
| 4,869,507 | A * | 9/1989 | Sahm | 473/337 |
| 5,273,283 | A * | 12/1993 | Bowland | 473/338 |
| 5,385,348 | A | 1/1995 | Wargo | |
| 5,518,243 | A * | 5/1996 | Redman | 473/334 |
| 5,582,553 | A * | 12/1996 | Ashcraft et al. | 473/345 |
| 5,788,584 | A * | 8/1998 | Parente et al. | 473/290 |
| 5,830,078 | A * | 11/1998 | McMahan | 473/252 |
| 5,871,407 | A * | 2/1999 | Tseng | 473/328 |
| 6,126,556 | A * | 10/2000 | Hsieh | 473/256 |
| 6,306,048 | B1 * | 10/2001 | McCabe et al. | 473/333 |
| 6,749,523 | B1 | 6/2004 | Forzano | |
| 6,773,360 | B2 * | 8/2004 | Willett et al. | 473/334 |
| 6,926,615 | B1 * | 8/2005 | Souza et al. | 473/251 |
| 7,147,573 | B2 | 12/2006 | DiMarco | |
| 7,172,513 | B1 * | 2/2007 | Rinker | 473/219 |
| 7,198,575 | B2 * | 4/2007 | Beach et al. | 473/324 |
| 7,223,180 | B2 | 5/2007 | Willett et al. | |
| 7,273,423 | B2 * | 9/2007 | Imamoto | 473/332 |
| 7,410,425 | B2 | 8/2008 | Willett et al. | |
| 7,410,426 | B2 | 8/2008 | Willett et al. | |
| 7,452,286 | B2 | 11/2008 | Lin et al. | |

(Continued)

FOREIGN PATENT DOCUMENTS

JP 7-15067 U 3/1995

(Continued)

*Primary Examiner* — Gene Kim
*Assistant Examiner* — Matthew B Stanczak
(74) *Attorney, Agent, or Firm* — Sughrue Mion, PLLC

(57) ABSTRACT

A golf club head of this invention includes a head body, a weight member attached to the head body, and a fixing unit to fix the weight member at one of a plurality of attachment positions of the head body. The plurality of attachment positions are located on a virtual cylindrical surface having the axis of a shaft to be mounted to the golf club head as a center.

13 Claims, 6 Drawing Sheets

U.S. PATENT DOCUMENTS

| | | | | |
|---|---|---|---|---|
| 7,572,193 | B2 * | 8/2009 | Yokota | 473/328 |
| 7,611,424 | B2 * | 11/2009 | Nagai et al. | 473/334 |
| 7,670,235 | B2 * | 3/2010 | Lo | 473/332 |
| 2005/0148405 | A1 * | 7/2005 | Imamoto | 473/338 |
| 2005/0221913 | A1 * | 10/2005 | Kusumoto | 473/345 |
| 2006/0122004 | A1 * | 6/2006 | Chen et al. | 473/335 |
| 2007/0238551 | A1 * | 10/2007 | Yokota | 473/349 |

FOREIGN PATENT DOCUMENTS

| | | | |
|---|---|---|---|
| JP | 9028844 | A | 2/1997 |
| JP | 11-009742 | A | 1/1999 |
| JP | 2001-137400 | A | 5/2001 |
| JP | 2006-102235 | A | 4/2006 |
| JP | 3127234 | U | 11/2006 |
| JP | 2007-222257 | A | 9/2007 |

* cited by examiner

GOLF CLUB HEAD

BACKGROUND OF THE INVENTION

1. Field of the Invention

The present invention relates to a golf club head.

2. Description of the Related Art

There have been proposed golf club heads in which golfers can change the position of a weight member attached to the golf club head in accordance with their preference. Japanese Patent Laid-Open Nos. 2001-137400, 2006-102235, and 2007-222257 disclose putter heads in which the position of the weight member can be changed. Japanese Utility Model Laid-Open No. 7-15067, Japanese Patent Laid-Open No. 11-9742, and Japanese Utility Model Registration No. 3127234 disclose wood type golf club heads in which the position of the weight member can be changed.

When the position of the weight member is changed, the center-of-gravity position of the golf club head changes. When the center-of-gravity position changes, the characteristics of the golf club head change and, for example, the height or lateral directionality of flight of a hit ball, playability, and the like change. Golfers can change the position of the weight member in accordance with their preference.

When the position of the weight member is changed, however, a plurality of characteristics of the golf club head may simultaneously change. Some golfers may want to keep the playability of the golf club unchanged but change other characteristics of the golf club head.

SUMMARY OF THE INVENTION

It is an object of the present invention to provide a golf club head in which the position of a weight member can be changed, and a change in playability of the golf club is suppressed as much as possible but other characteristics of the golf club head can be changed by changing the position of the weight member.

According to the present invention, there is provided a golf club head comprising a head body, a weight member attached to the head body, and fixing means for fixing the weight member at any one of a plurality of attachment positions of the head body, wherein the plurality of attachment positions are located on a virtual cylindrical surface having an axis of a shaft to be attached to the golf club head as a center.

Further features of the present invention will become apparent from the following description of exemplary embodiments with reference to the attached drawings.

BRIEF DESCRIPTION OF THE DRAWINGS

FIGS. 3A and 3B are sectional views of an attachment portion 131*a* taken along a line X-X in FIG. 1, in which FIG. 3A shows a state in which a weight member 20 is detached and FIG. 3B shows a state in which the weight member 20 is attached;

DESCRIPTION OF THE EMBODIMENTS

Preferred embodiments of the present invention will now be described in detail in accordance with the accompanying drawings.

First Embodiment

Figure 1:
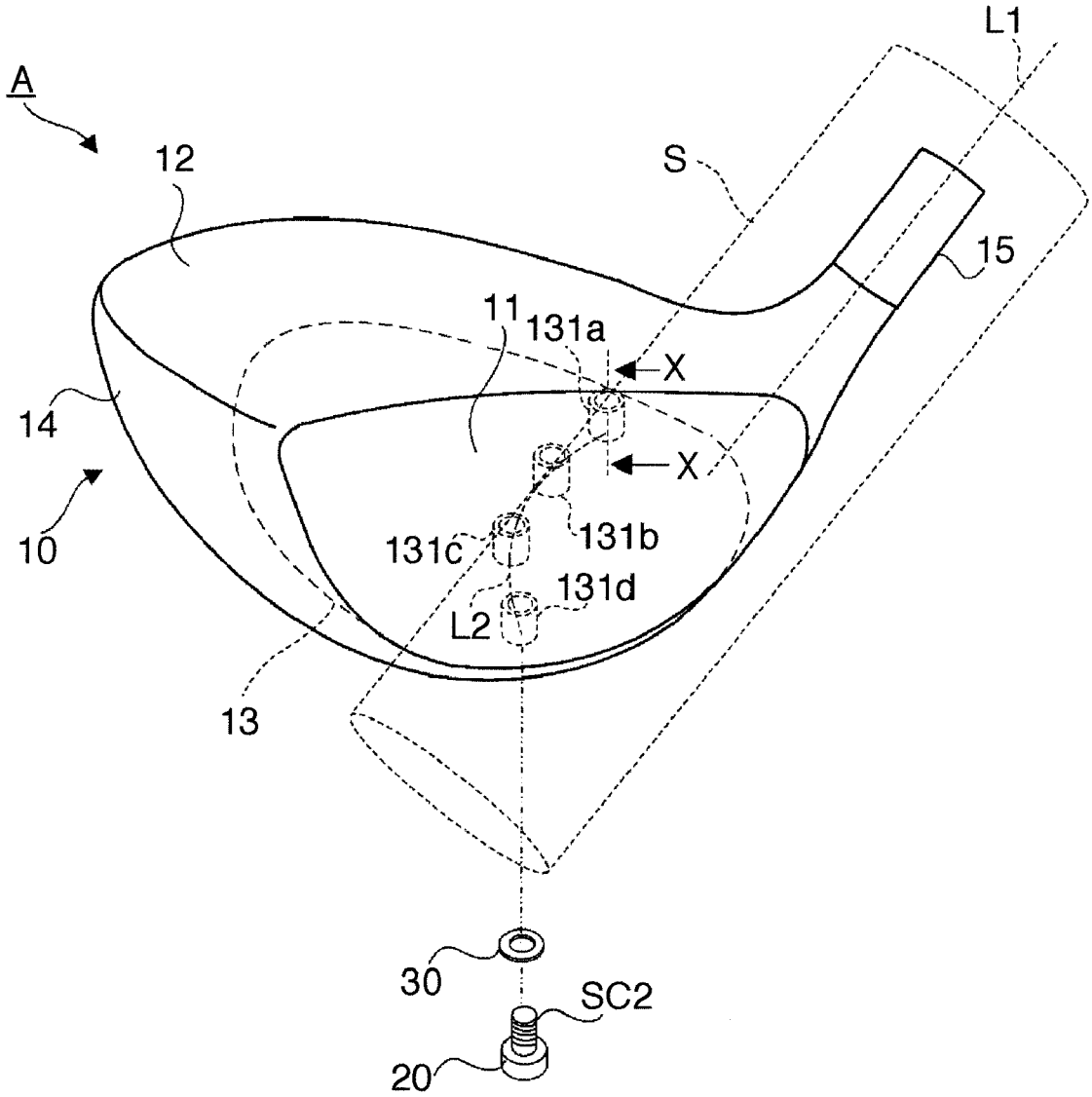
FIG. 1 is a perspective view of a golf club head A according to one embodiment of the present invention.

FIG. 1 is a perspective view of a golf club head A, and particularly of a sole portion 13 according to one embodiment of the present invention.

The golf club head A includes a head body 10 and a weight member 20. The head body 10 is a hollow body, and its circumferential wall constitutes a face portion 11 forming a golf ball hitting surface, a crown portion 12 forming the top surface of the golf club head A, the sole portion 13 forming the bottom surface of the golf club head A, and a side portion 14 forming the toe-side, heel-side, and back-side side surfaces of the golf club head A. A hosel portion 15 to which a shaft is to be attached is also provided in the head body 10. A line L1 represents the axis of the shaft to be attached to the hosel portion 15, which is substantially the same as the center axis of the hosel portion 15.

Although the golf club head A is a golf club head for a driver, the present invention is applicable to wood type golf club heads including a fairway wood and the like other than a driver, utility type (hybrid type) golf club heads, and other hollow golf club heads. The head body 10 is a hollow body in this embodiment, but it may be solid.

The head body 10 can be assembled by joining a plurality of parts. For example, the face portion 11 and the other part can be formed as different members and joined to form the head body 10. Also, the face portion 11, sole portion 13, and the other part can be formed as different members and joined to form the head body 10. The head body 10 can be made from e.g., a metal material including a titanium metal material and stainless steel. The head body 10 can be made from different materials. For example, it can be made from a metal material and a carbon fiber material. As a carbon fiber material, a carbon fiber reinforced resin (CFRP) is available.

Figure 3A:
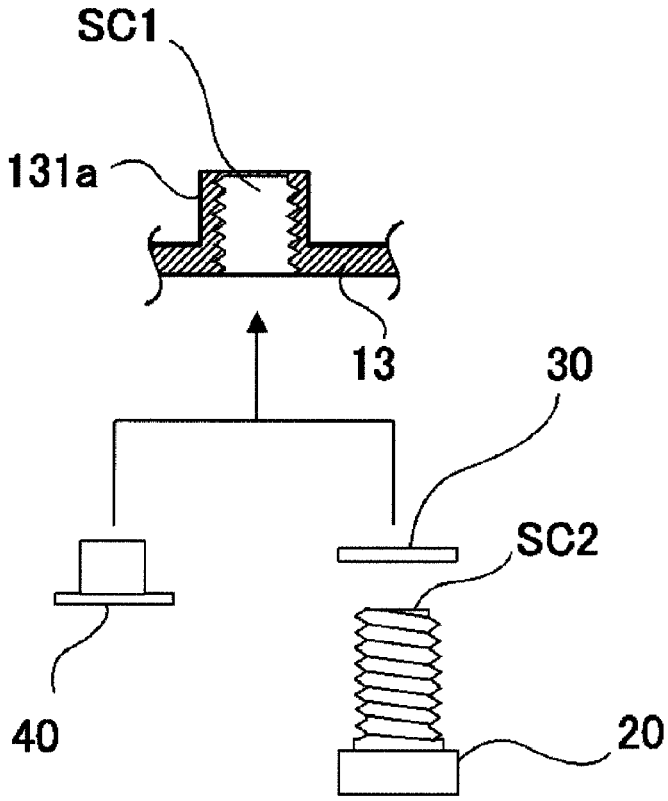
Figure 3B:
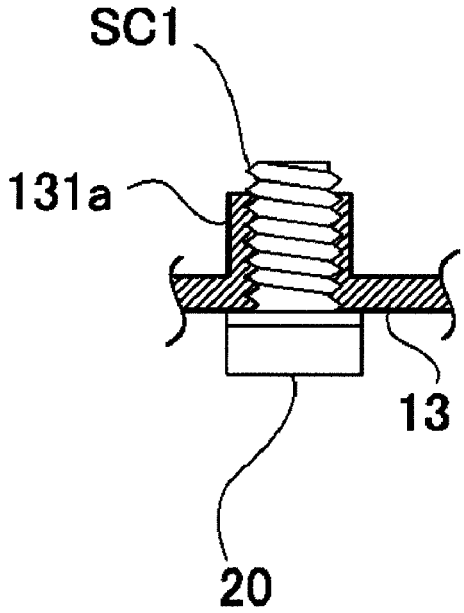

A plurality of attachment portions 131*a* to 131*d*, which define the attachment positions of the weight member 20, are formed in the sole portion 13. Although four attachment portions 131*a* to 131*d* are provided in this embodiment, the number of the attachment portions is not limited to four. The user of the golf club head A can attach the weight member 20 to any one of the attachment portions 131*a* to 131*d*. FIGS. 3A and 3B are sectional views of the attachment portion 131*a* taken along a line X-X in FIG. 1, in which FIG. 3A shows a state in which the weight member 20 is detached and FIG. 3B shows a state in which the weight member 20 is attached. Although the arrangement of the attachment portion 131*a* will be described herein, the attachment portions 131*b* to 131*d* have the same arrangement.

The attachment portion 131*a* forms a tube having a female screw hole SC1. The weight member 20 has an axial male screw portion SC2. The weight member 20 can be fixed to the head body 10 by threadably engaging the female screw hole SC1 and male screw portion SC2 to each other.

A washer 30 is a vibration dampening member inserted between the weight member 20 and the sole portion 13, which is a resin member in this embodiment. The washer 30 serves to prevent loose threadable engagement between the female screw hole SC1 and male screw portion SC2, thereby preventing the weight member 20 from falling easily, once fixed. The washer 30 also has an effect of attenuating the vibration of the golf club head A that occurs at impact. A resin material is preferable as such a vibration dampening member, but materials of other kinds can also be employed. Note that the washer 30 may be integrally provided in the weight member 20. For example, the washer 30 may be fixed to the weight member 20 in advance. Also, the surface of the weight member 20 may be covered with a resin material or the like.

Of the attachment portions 131*a* to 131*d*, the female screw holes SC1 to which the weight member 20 is not attached can be closed by attaching caps 40 shown in FIG. 3A. With this arrangement, it is possible to prevent dust and the like from entering the head body 10 through the female screw holes SC1. The cap 40 is made from, e.g., a resin material, and detachably fitted in the female screw hole SC1. In order to prevent dust and the like from entering the head body 10 through the female screw holes SC1, instead of using the caps 40, the female screw holes SC1 may be closed at their upper ends.

The cap 40 is formed to have the same shape as the weight member 20. The material of the cap 40 is selected such that its weight substantially gives no influence on a change in center-of-gravity position. The cap 40 may be formed to screw in the female screw hole SC1.

The weight member 20 can be made from, e.g., a metal material. As such a metal material, for example, tungsten, a tungsten alloy, aluminum, an aluminum alloy, magnesium, and a magnesium alloy are available. The weight member 20 may be made by, e.g., mixing a metal powder with a viscoelastic material. In this case, the vibration dampening effect of the golf club head A at impact can improve. As such a viscoelastic material, for example, NBR (acrylonitrile-butadiene rubber) is available.

Figure 2:
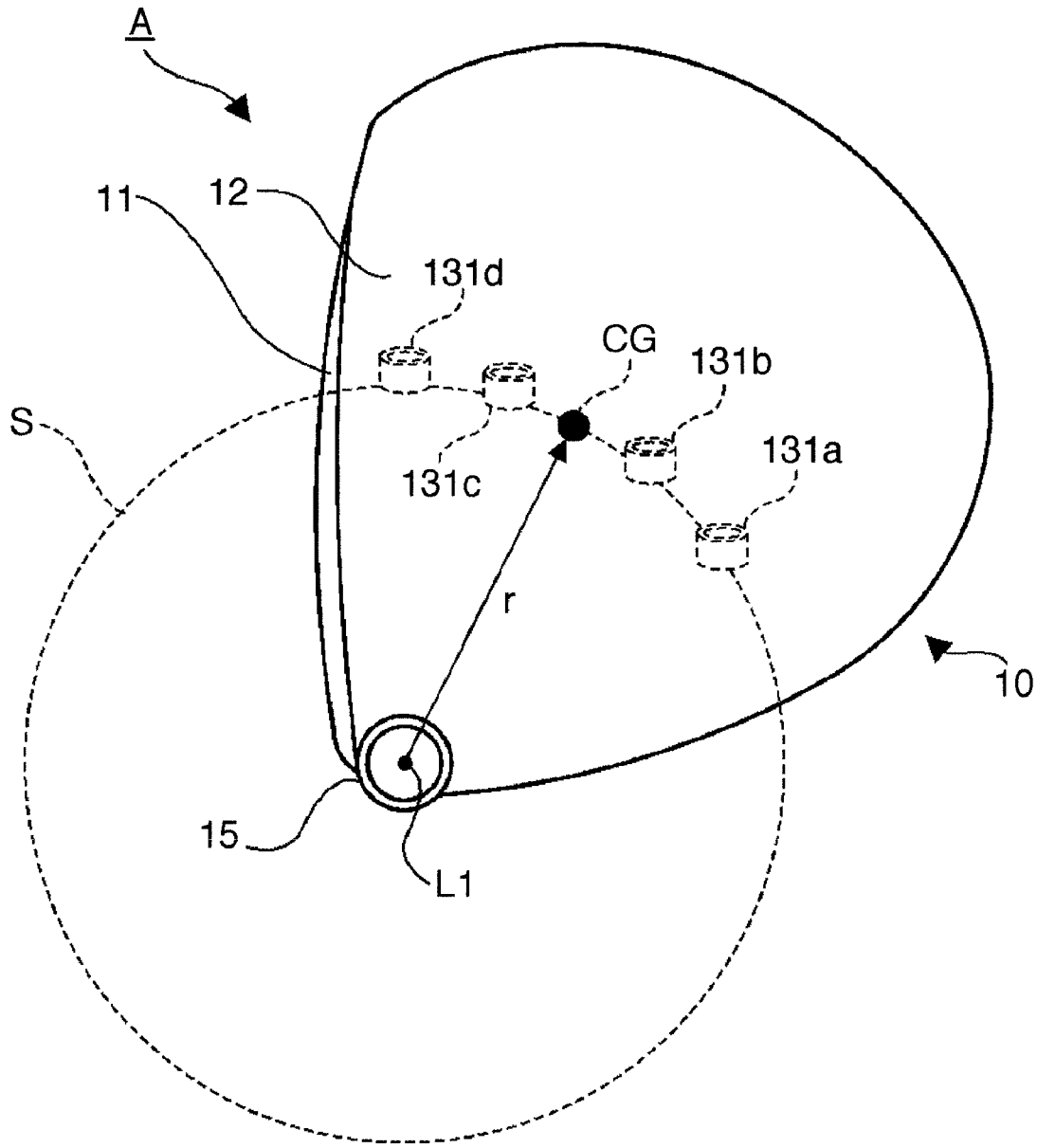
FIG. 2 is a view of the golf club head A seen from a hosel portion 15 side in the direction of a line L1.

The positions of the attachment portions 131*a* to 131*d* will be described with reference to FIGS. 1 and 2. FIG. 2 is a view of the golf club head A seen from the hosel portion 15 side in the direction of the line L1, and particularly a perspective view of the attachment portions 131*a* to 131*d*.

In FIGS. 1 and 2, a surface S is a virtual cylindrical surface having the line L1 as the center. A line L2 is a virtual line representing a part of the intersection line of the surface S and sole portion 13. The attachment portions 131*a* to 131*d* are located on the surface S, and particularly on the virtual line L2.

In FIG. 2, a center-of-gravity position CG represents the center-of-gravity position of the head body 10 without the weight member 20 attached thereto, and a length r represents the center-of-gravity length when the weight member 20 is not attached. Note that the center-of-gravity length is the length of a perpendicular line from the center-of-gravity position to the shaft axis. In this embodiment, the radius of the surface S is set to be the length r.

Figure 6:
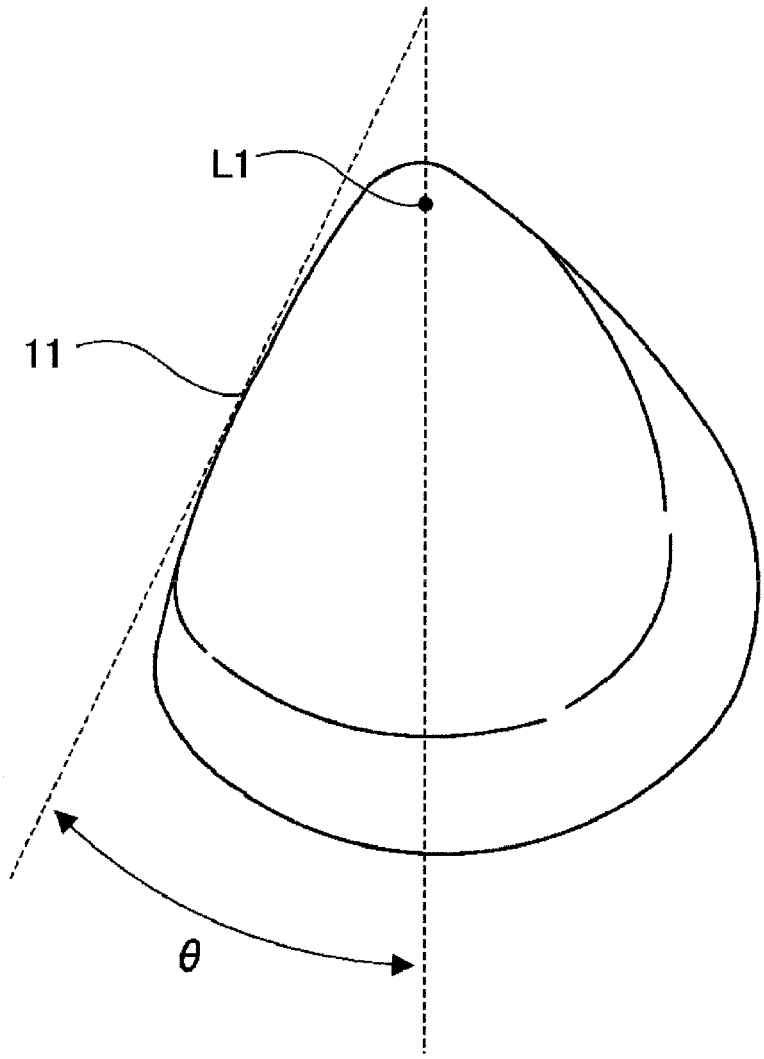
FIG. 6 is a view for explaining a center-of-gravity angle.

The effect obtained by arranging the attachment portions 131*a* to 131*d* on the surface S will be described next. When the weight member 20 is fixed to any one of the attachment portions 131*a* to 131*d*, the center-of-gravity angle of the golf club head A changes accordingly. In this specification, the center-of-gravity angle is an angle formed by the vertical direction and face portion when the shaft is horizontally supported while the golf club is kept rotatable about the shaft. FIG. 6 is a view for explaining the center-of-gravity angle. In FIG. 6, an angle θ formed by the face portion 11 and a dashed line in the vertical direction that passes the shaft axis L1 is the center-of-gravity angle. As shown in FIG. 6, in case of a wood type club, the face portion 11 normally does not form a flat surface. Therefore, the direction of the face portion 11 uses the tangential direction of the leading edge of the face center as a reference.

For example, when the weight member 20 is attached to the attachment portion 131*a*, the center-of-gravity angle of the golf club head A becomes relatively large. When the center-of-gravity angle becomes large, ball catchability relatively improves, and a ball is easily hooked. When the weight member 20 is attached to the attachment portion 131*d*, the center-of-gravity angle of the golf club head A becomes relatively small. When the center-of-gravity angle becomes small, golf ball catchability is relatively suppressed, and a ball is easily sliced.

As described above, in this embodiment, the characteristics of the golf club head A can be changed by selecting the attachment portions 131*a* to 131*d* used to fix the weight member 20.

The playability of a golf club depends on the moment of inertia of the golf club head about the shaft axis. That is, the large moment of inertia of the golf club head about the shaft axis discourages faster golf club head rotation through impact, and the small moment of inertia of the golf club head about the shaft axis encourages faster golf club head rotation through impact.

In this embodiment, the attachment portions 131*a* to 131*d* are located on the surface S. Hence, regardless of the attachment portions 131*a* to 131*d* used to attach the weight member 20, the length between the attachment portion and line L1 (the length of the perpendicular to the line L1) remains the same, as can be understood from FIG. 2. Accordingly, an increase in moment of inertia of the golf club head A about the line L1 caused by attaching the weight member 20 remains the same regardless of the attachment portions 131*a* to 131*d* used to attach the weight member 20, as long as the weight of the weight member 20 remains the same. Therefore, the playability of the golf club does not change.

For this reason, although the center-of-gravity angle changes depending on the attachment position of the weight member 20, the playability of the golf club hardly changes. Hence, a golfer can selectively hook or slice a ball with little change in his or her hitting manner.

As described above, in this embodiment, a change in playability of the golf club having the golf club head A can be suppressed as much as possible but other characteristics of the golf club head A can be changed by changing the attachment position of the weight member 20.

Advanced players have a sharp sense for golf clubs. Accordingly, the farther the attachment position of the weight member 20 is from the center-of-gravity position CG of the head body 10, the more readily the advanced players may recognize the presence of the weight member 20 in regard to the playability of golf club, and feel a sense of discomfort from the swing feel of golf club. In order to reduce the sense of discomfort, the radius of the virtual cylindrical surface S is desirably equal to or smaller than the length r as the center-of-gravity length of the center-of-gravity position CG of the head body 10 (e.g., length r≧radius of virtual cylindrical surface S≧length r−5 mm), as in this embodiment. Optimally, the radius of the virtual cylindrical surface S is equal to the length r, as in this embodiment.

Although the one weight member 20 is used in this embodiment, one of a plurality of the weight members 20 having different weights may be selectively fixed to the head body 10. With this arrangement, it becomes possible to widen the selection range of center-of-gravity position and center-of-gravity depth of the golf club head A and to increase their choices as well. In this case, the two or more weight members 20 may simultaneously be fixed to the head body 10.

The change amount of center-of-gravity angle of the golf club head A caused by the difference between the attachment portions 131*a* to 131*d* used to fix the weight member 20, for example, the difference in center-of-gravity angle between a case in which the weight member 20 is attached to the attachment portion 131*a* and a case in which the weight member 20 is attached to the attachment portion 131*d*, is preferably 3° or more. When the difference in center-of-gravity angle is 3° or more, a golfer can more clearly feel the change in characteristics of the golf club head caused by the change in center-of-gravity position.

Second Embodiment

Figure 4A:
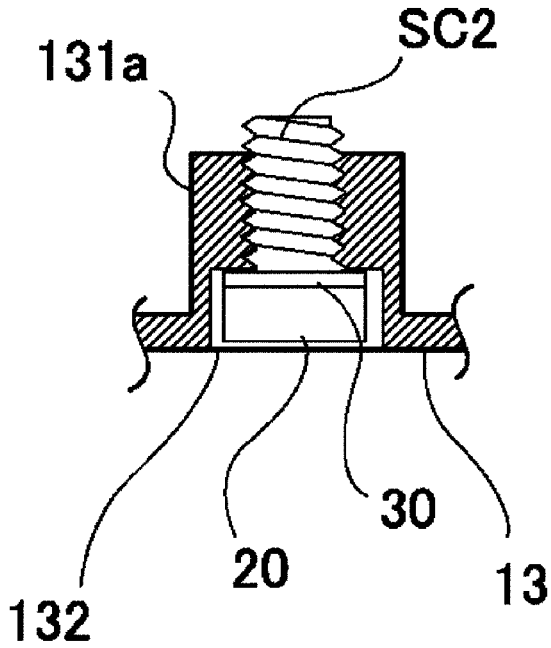
FIG. 4A is a sectional view showing the arrangement of an attachment portion 131*a* according to the second embodiment of the present invention.

FIG. 4A is a sectional view showing another arrangement example of the attachment portion 131*a*, which corresponds to the sectional view of an attachment portion 131*a* taken along the line X-X in FIG. 1. The same components as in the golf club head A of the above-described first embodiment are denoted by the same reference numerals below, and a description thereof will not be repeated. Only components different from those of the golf club head A will be described. Although the attachment portion 131*a* will be described herein, attachment portions 131*b* to 131*d* have the same arrangement.

In this embodiment, a recess 132 to accommodate a weight member 20 is provided in the attachment portion 131*a*. The depth of the recess 132 is set such that the lowest portion of the weight member 20 fixed to a head body 10 is positioned above the lowest portion of a sole portion 13.

With this arrangement, as shown in FIG. 4A, the weight member 20 does not project from the sole portion 13. Accordingly, it is possible to prevent the weight member 20 from catching the ground upon hitting a ball.

Third Embodiment

Figure 4B:
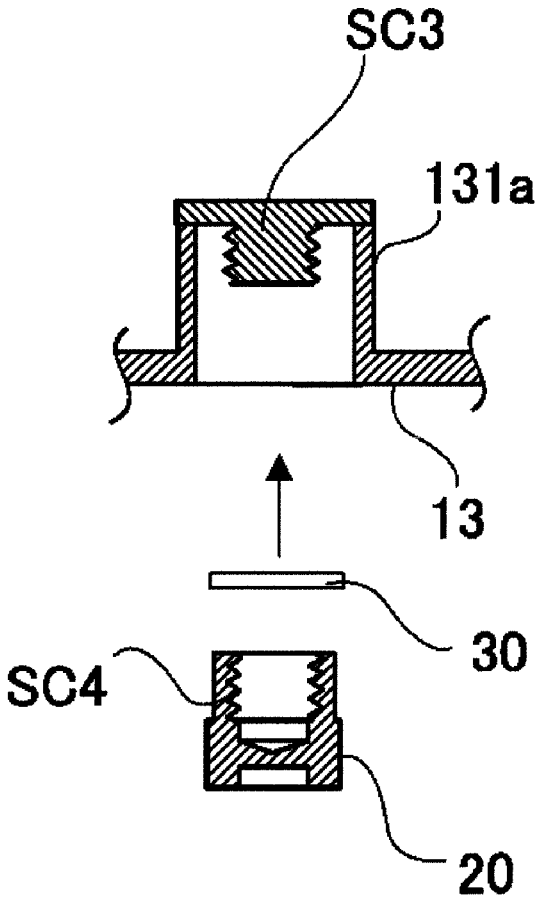
FIG. 4B is a sectional view showing the arrangement of an attachment portion 131*a* and a weight member 20 according to the third embodiment of the present invention.

FIG. 4B is a sectional view showing another arrangement example of the attachment portion 131*a* and weight member 20, which corresponds to the sectional view of an attachment portion 131*a* taken along the line X-X in FIG. 1. The same components as in the golf club head A of the above-described first embodiment are denoted by the same reference numerals below, and a description thereof will not be repeated. Only components different from those of the golf club head A will be described. Although the attachment portion 131*a* will be described herein, attachment portions 131*b* to 131*d* have the same arrangement.

In this embodiment, an axial male screw portion SC3 is provided in the attachment portion 131*a*, and a female screw hole SC4 which threadably engages with the male screw portion SC3 is provided in a weight member 20. The attachment portion 131*a* has an internal space to accommodate the weight member 20, thereby preventing the weight member 20 from projecting from a sole portion 13, as in the above-described second embodiment.

In this manner, the screw portion on the sole portion 13 side and that on the weight member 20 side may be a male screw and female screw, respectively, and vice versa.

Fourth Embodiment

In the above-described first to third embodiments, the weight member 20 can be fixed at a plurality of positions separated from each other. However, a weight member 20 may be fixable at a given position on a vertical line included in a surface S. With this arrangement, it is possible to more finely adjust the center-of-gravity position and center-of-gravity depth of the golf club head.

Figure 5A:
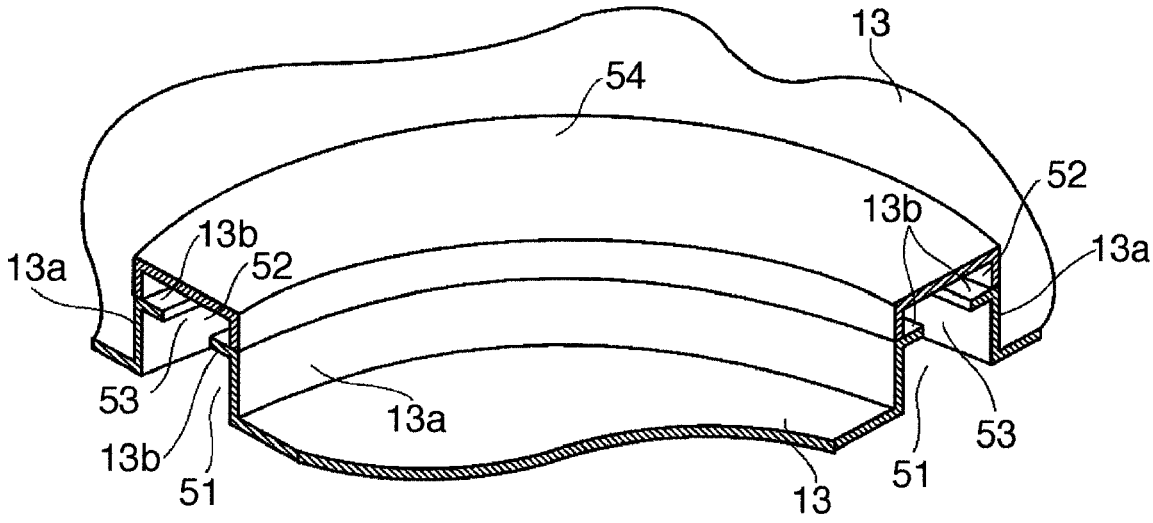
FIG. 5A is a perspective view of a rail portion 50 formed in a sole portion 13.
Figure 5B:
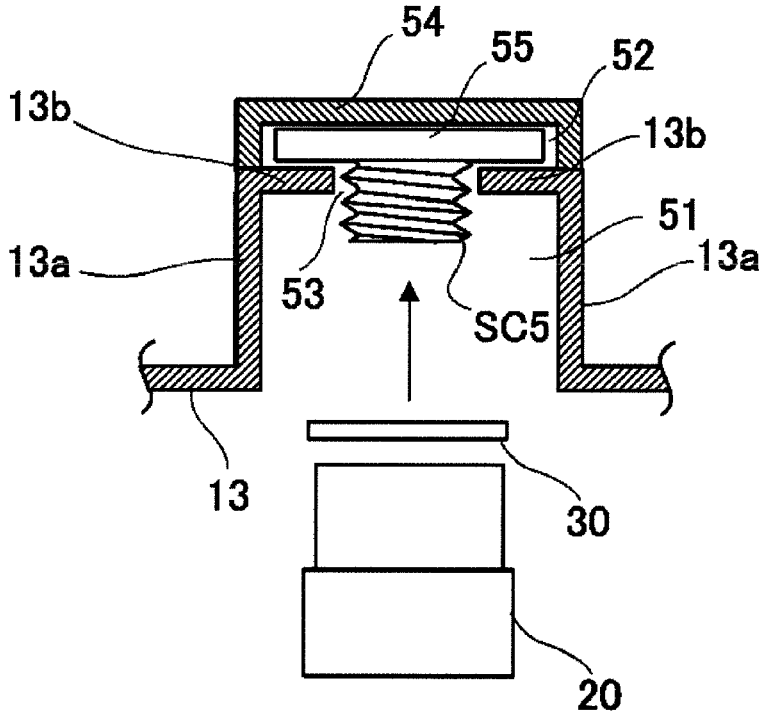
FIG. 5B is a sectional view of the rail portion 50.
Figure 5C:
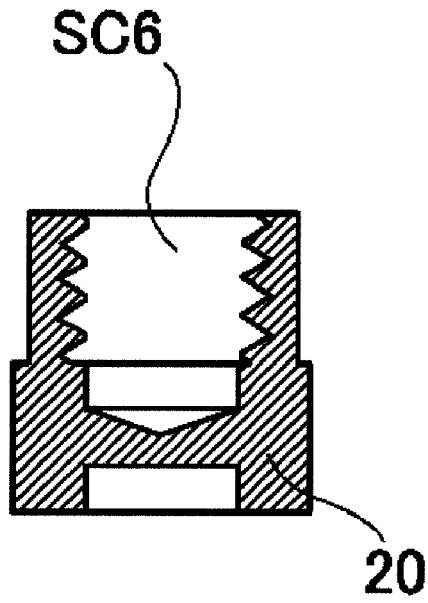
FIG. 5C is a sectional view of the weight member 20.

FIG. 5A is a perspective view of a rail portion 50 formed in a sole portion 13, FIG. 5B is a sectional view of the rail portion 50, and FIG. 5C is a sectional view of the weight member 20. The same components as in the golf club head A of the above-described first embodiment are denoted by the same reference numerals below, and a description thereof will not be repeated. Only components different from those of the golf club head A will be described.

The rail portion 50 extending along a virtual line L2 (see FIG. 1) included in the surface S is formed in the sole portion 13. As described below, the rail portion 50 guides the movement of the weight member 20. The rail portion 50 includes a groove 51 formed by recessing the sole portion 13 and open at its lower part, and a partitioned chamber 52 formed in the upper portion of the groove 51. Both the groove 51 and partitioned chamber 52 are formed along the above-described virtual line L2. Note that although not shown in FIG. 5A, the each end portion of the rail portion 50 is appropriately closed.

The groove 51 has a pair of side walls 13*a* and a pair of partitioning portions 13*b* formed by bending the side walls 13*a*. The partitioning portions 13*b* are located between the groove 51 and partitioned chamber 52, thereby vertically partitioning them. The pair of the partitioning portions 13*b* are spaced apart from each other to form a slit 53. The groove 51 accommodates the weight member 20. The depth of the groove 51 is set such that the lowest portion of the weight member 20 fixed to the head body 10 is positioned above the lowest portion of the sole portion 13. With this arrangement, the weight member 20 does not project from the sole portion 13, and therefore it is possible to prevent the weight member 20 from catching the ground upon hitting a ball.

The partitioned chamber 52 is formed by joining the lower ends of a lid member 54 having a U-shaped cross section to the partitioning portions 13*b*. The upper part of the partitioned chamber 52 is closed by the lid member 54.

The partitioned chamber 52 accommodates a slide member 55. The slide member 55 is sized such that it cannot rotate in the partitioned chamber 52 and, for example, has a square shape when viewed from above. An axial male screw portion SC5 that passes the slit 53 is integrally connected to the slide member 55. A female screw hole SC6 which threadably engages with the male screw portion SC5 is formed in the weight member 20. The width of the weight member 20 is larger than that of the slit 53 in the widthwise direction.

In this embodiment with the above-described components, when the male screw portion SC5 threadably engages with the female screw hole SC6, the slide member 55 and weight member 20 sandwich the partitioning portions 13*b*, thereby fixing the weight member 20 to the head body 10. A washer 30 inserted between the partitioning portions 13*b* and weight member 20 prevents the loose threadable engagement between the male screw portion SC5 and female screw hole SC6.

When changing the position of the weight member 20, the threadable engagement between the male screw portion SC5 and female screw hole SC6 is loosened, and the slide member 55 and the weight member 20 are moved. Since these members are guided by the rail portion 50 during movement, their positions can be easily changed. By threadably engaging the male screw portion SC5 with the female screw hole SC6 at a desired position, the weight member 20 can be fixed.

As described above, in this embodiment, the weight member 20 can be fixed at a given position on the virtual line L2, and therefore it is possible to more finely adjust the center-of-gravity position and center-of-gravity depth of the golf club head. Note that in this embodiment, the center-of-gravity position of the head body 10 is defined as a center-of-gravity position CG of the head body 10 without the weight member 20 and slide member 55. Also, in this embodiment, since the weight member 20 can be completely detached from the slide member 55, one of a plurality of the weight members 20 having different weights may be selectively fixed to the head body 10.

In this embodiment, since the rail portion 50 is enclosed by a closing member 141, the wall portion 16, and the lid member 54, it is possible to prevent dust and the like from entering the head body 10 through the rail portion 50.

Note that the structure of the rail portion 50 is not limited to that shown in FIGS. 5A and 5B, and any structure can be used as long as the weight member 20 can be moved and fixed at a given position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-330932, filed Dec. 25, 2008, which is hereby incorporated by reference herein in its entirety.

What is claimed is:

1. A golf club head comprising:

a head body;

a weight member attached to said head body; and fixing means for fixing said weight member at any one of a plurality of attachment positions of said head body, wherein the plurality of attachment positions are located in a sole portion of said head body and on a virtual cylindrical surface having an axis of a shaft to be attached to the golf club head as a center.

2. The head according to claim 1, wherein a center-of-gravity length of said head body without said weight member attached thereto is positioned on the virtual cylindrical surface.

3. The head according to claim 1, wherein said fixing means comprises:

a plurality of first screw portions which are provided in the sole portion and define the plurality of attachment positions; and a second screw portion which is provided in said weight member and threadably engages with said first screw portion.

4. The head according to claim 1, further comprising a rail portion which is formed along a virtual line on the virtual cylindrical surface in said sole portion and defines the plurality of attachment positions, wherein said fixing means fixes said weight member at a given position on said rail portion.

5. The head according to claim 4, characterized in that said rail portion comprises:

a groove open at a lower part thereof, which is formed along the virtual line and forms an accommodation space to accommodate said weight member;

a partitioned chamber closed at an upper part thereof, which is formed along the virtual line in an upper portion of said groove;

a partitioning portion which is provided between said groove and said partitioned chamber and vertically partitions the space in said groove from said partitioned chamber; and a slit which is formed along the virtual line in said partitioned chamber and makes the space in said groove communicate with said partitioned chamber, and said fixing means comprises:

a slide member which is accommodated in said partitioned chamber such that it can move along the virtual line and connected to said weight member through said slit; and screw portions which are respectively provided in said slide member and said weight member, and threadably engage with each other.

6. The head according to claim 1, wherein a change amount of center-of-gravity angle of the golf club head caused by a difference between the attachment positions used to fix said weight member is not less than 3 degrees.

7. The head according to claim 1, further comprising a plurality of said weight members having different weights.

8. The head according to claim 1, further comprising a vibration damping member which is inserted between said head body and said weight member at the attachment position.

9. The head according to claim 8, wherein said vibration damping member is integrally provided in said weight member.

10. The head according to claim 1, wherein said weight member is fixed to said sole portion of said head body, said sole portion has a recess formed in the attachment position of said weight member, and a depth of said recess is set such that a lowest portion of said weight member fixed to said head body is positioned above a lowest portion of said sole portion.

11. The head according to claim 1, wherein all attachment positions in the sole portion are located on the virtual cylindrical surface.

12. A golf club head comprising:

a head body; and a weight member attached to said head body at any one of a plurality of attachment positions of said head body, wherein the plurality of attachment positions are located in a sole portion of said head body and on a virtual cylindrical surface having an axis of a shaft to be attached to the golf club head as a center.

13. The head according to claim 12, wherein all attachment positions in the sole portion are located on the virtual cylindrical surface.

* * * * *